US007568940B2

(12) United States Patent
Cheng et al.

(10) Patent No.: US 7,568,940 B2
(45) Date of Patent: Aug. 4, 2009

(54) CABLE ASSEMBLY EQUIPPED WITH SENSOR

(75) Inventors: Wei-Ya Cheng, Kunshan (CN); Su-Feng Liu, Kunshan (CN); Bin Xu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/286,693

(22) Filed: Sep. 30, 2008

(65) Prior Publication Data

US 2009/0130896 A1 May 21, 2009

(30) Foreign Application Priority Data

Nov. 21, 2007 (CN) ..... 2007 2 0042399 U

(51) Int. Cl.
*H01R 3/00* (2006.01)

(52) U.S. Cl. ..... 439/489; 439/76.1; 439/913

(58) Field of Classification Search ..... 439/76.1, 439/488, 489, 913
See application file for complete search history.

(56) References Cited

U.S. PATENT DOCUMENTS 5,871,375 A * 2/1999 Muzslay ..... 439/599
6,045,405 A * 4/2000 Geltsch et al. ..... 439/620.24
6,443,770 B1 * 9/2002 Lin ..... 439/620.05
6,590,777 B2 * 7/2003 Morino et al. ..... 361/736
6,780,060 B1 * 8/2004 Kajiura et al. ..... 439/620.21
6,945,816 B1 9/2005 Wu
7,261,571 B2 * 8/2007 Chen et al. ..... 439/68
7,291,023 B1 * 11/2007 Still et al. ..... 439/76.1
7,491,097 B2 * 2/2009 Ishihara et al. ..... 439/763
2004/0161959 A1 * 8/2004 Kato et al. ..... 439/164
2006/0110962 A1 * 5/2006 Powell et al. ..... 439/169
2006/0216800 A1 * 9/2006 Ishihara et al. ..... 435/135
2007/0010138 A1 * 1/2007 Ohnishi ..... 439/736
2008/0070433 A1 * 3/2008 Zeigler ..... 439/206

* cited by examiner

*Primary Examiner*—James Harvey
(74) *Attorney, Agent, or Firm*—Wei Te Chung

(57) ABSTRACT

A cable assembly (1) includes an insulated housing (2) having a base portion (21) and a mating portion (22) extending forwardly from the base portion; a plurality of terminals (3) received in the insulated housing; a retainer (214) formed on the base portion, said retainer defining a cavity (215) with a rear outlet; a sensor (7) accommodated in the cavity of the retainer; and a lid member (8) covering the rear outlet of the retainer.

15 Claims, 5 Drawing Sheets

CABLE ASSEMBLY EQUIPPED WITH SENSOR

FIELD OF THE INVENTION

The present invention generally relates to a cable assembly, and more particularly to a cable assembly equipped with a sensor.

DESCRIPTION OF PRIOR ART

A cable assembly is used for interconnecting two or more electronic devices for data exchange therebetween. A sensor is widely utilized for detecting different running parameters of an electronic device or other gadget, such as temperature, pressure, speed, voltage, etc. A cable assembly with a sensor thereon may be required if an running state of corresponding device should be monitored. However, if a sensor is directly mounted to connector of the cable assembly without any precaution, it would be easily damaged when the cable assembly is manufactured.

Hence, an improved cable assembly is highly desired to overcome the aforementioned problems.

SUMMARY OF THE INVENTION

Accordingly, an object of the present invention is to provide a cable assembly equipped with a sensor which is well protected.

In order to achieve the object set forth, a cable assembly in accordance with the present invention comprises an insulated housing having a base portion and a mating portion extending forwardly from the base portion; a plurality of terminals received in the insulated housing; a retainer formed on the base portion, said retainer defining a cavity with a rear outlet; a sensor accommodated in the cavity of the retainer; and a lid member covering the rear outlet of the rear outlet.

Other objects, advantages and novel features of the invention will become more apparent from the following detailed description when taken in conjunction with the accompanying drawings.

DETAILED DESCRIPTION OF PREFERRED EMBODIMENTS

Reference will now be made in detail to the preferred embodiment of the present invention.

Figure 1:
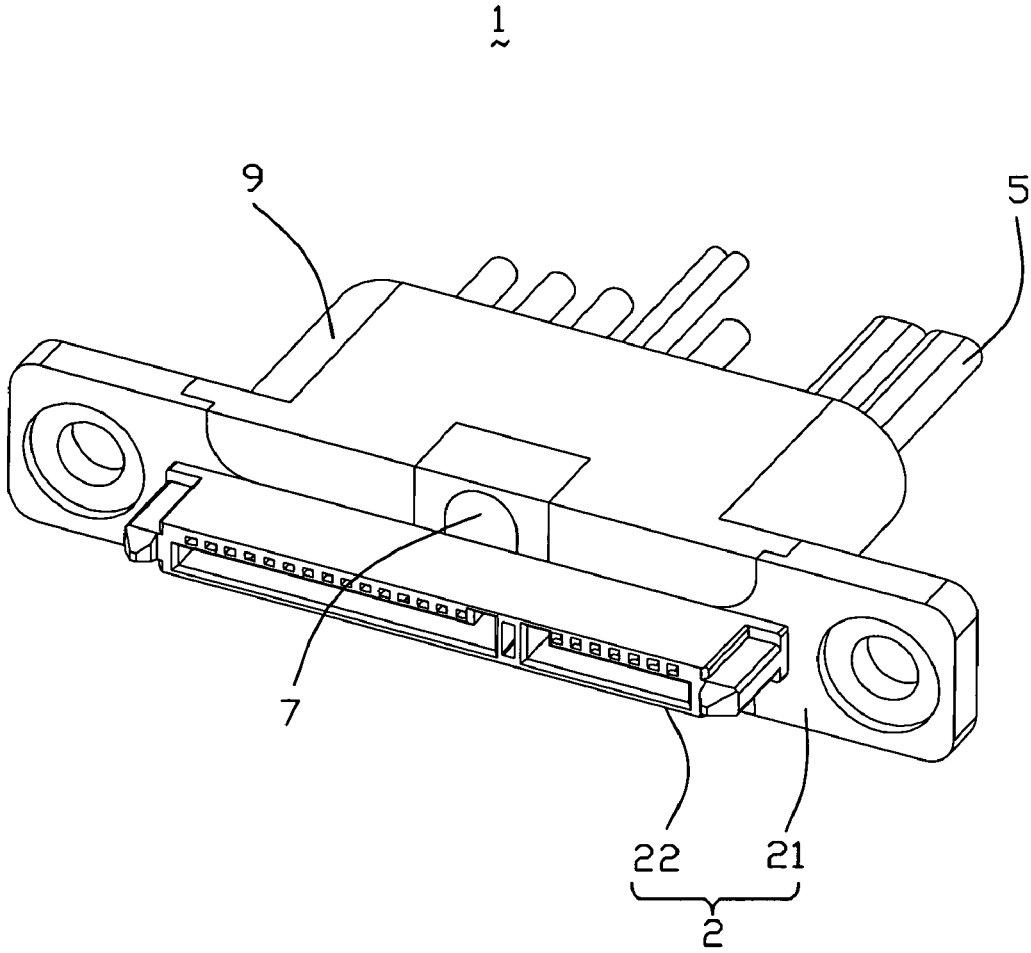
FIG. 1 is an assembled, perspective view of a cable assembly in accordance with the present invention.
Figure 2:
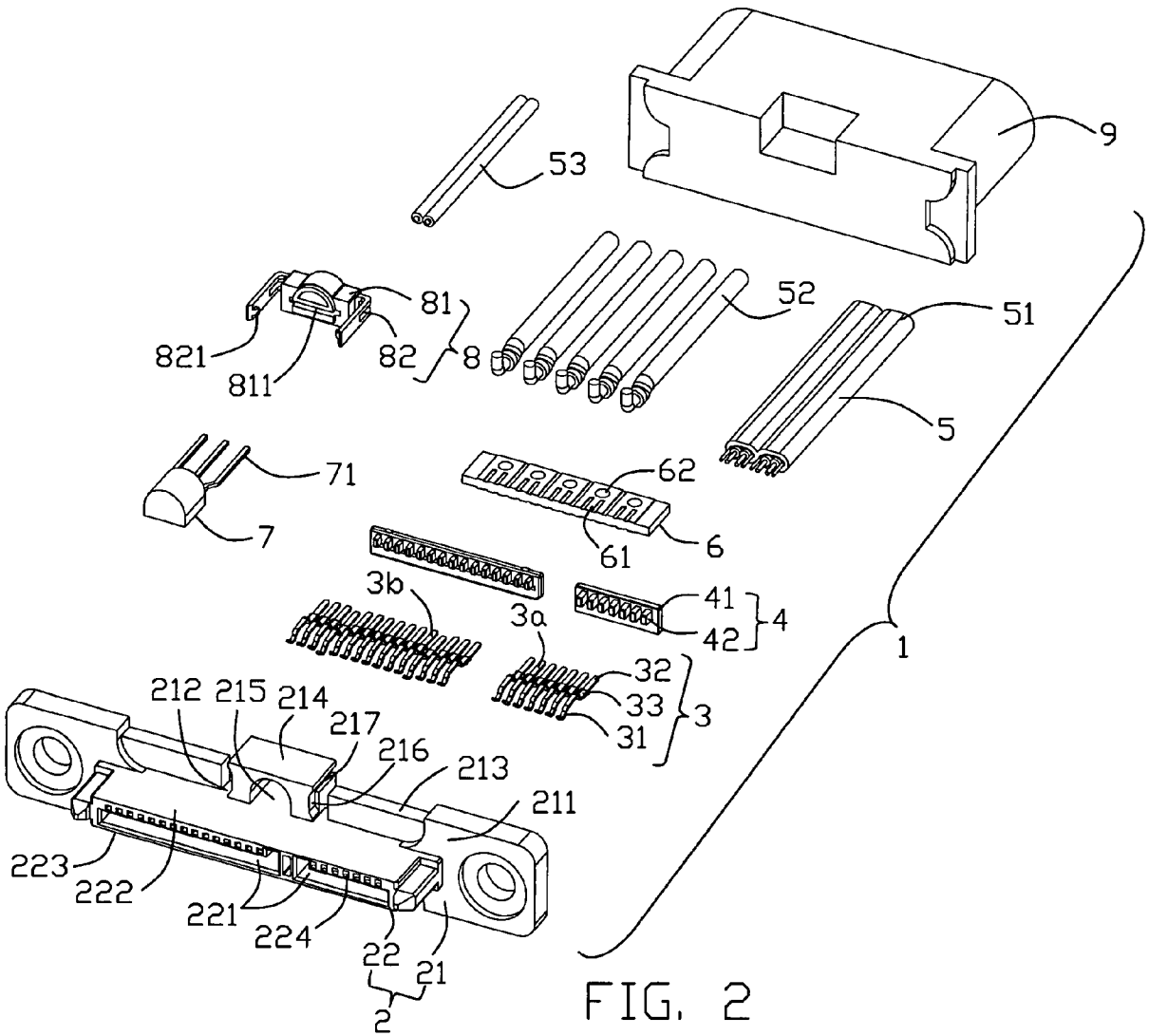
FIG. 2 is an exploded, perspective view of the cable assembly.
Figure 3:
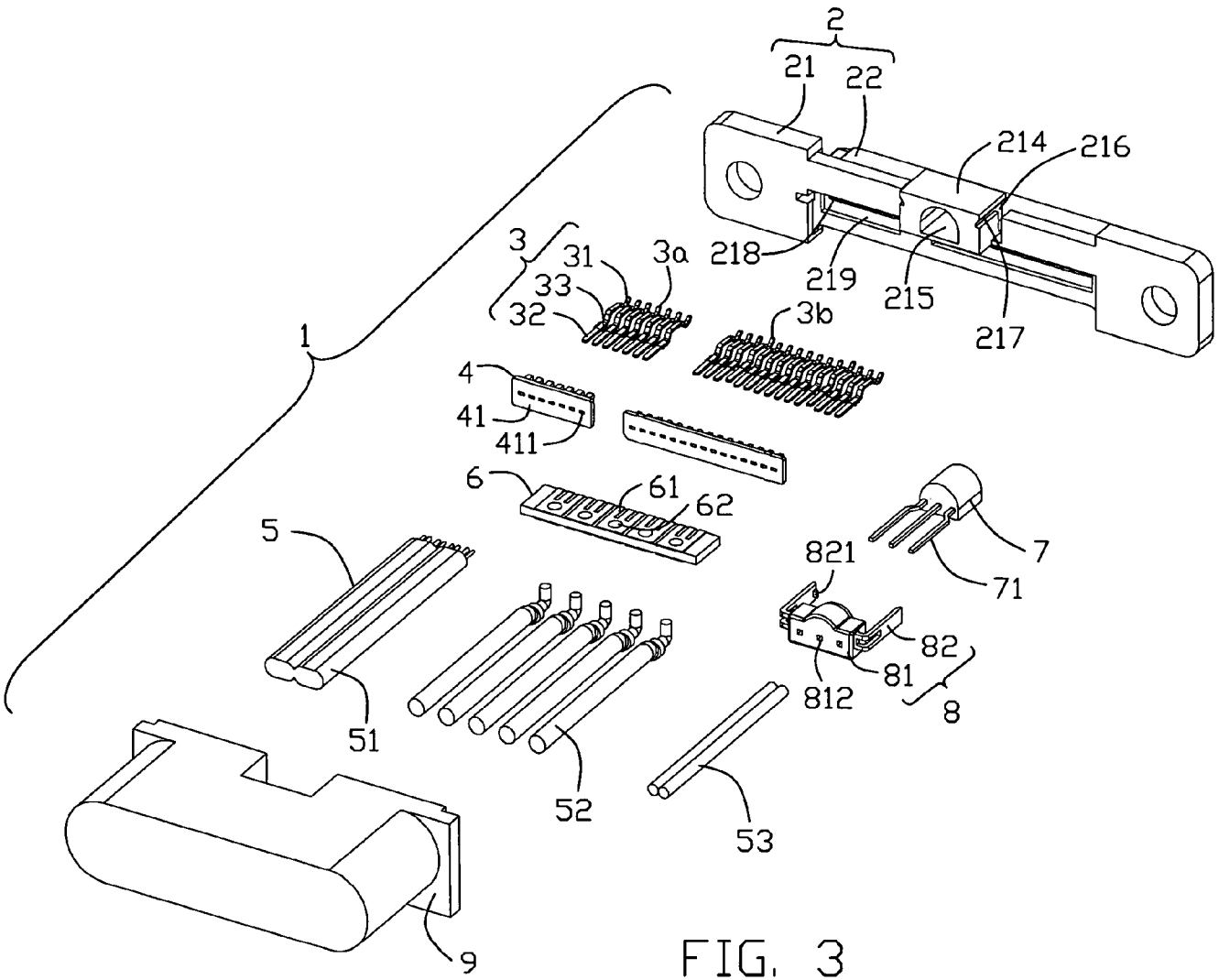
FIG. 3 is similar to FIG. 2, but viewed from another aspect.
Figure 4:
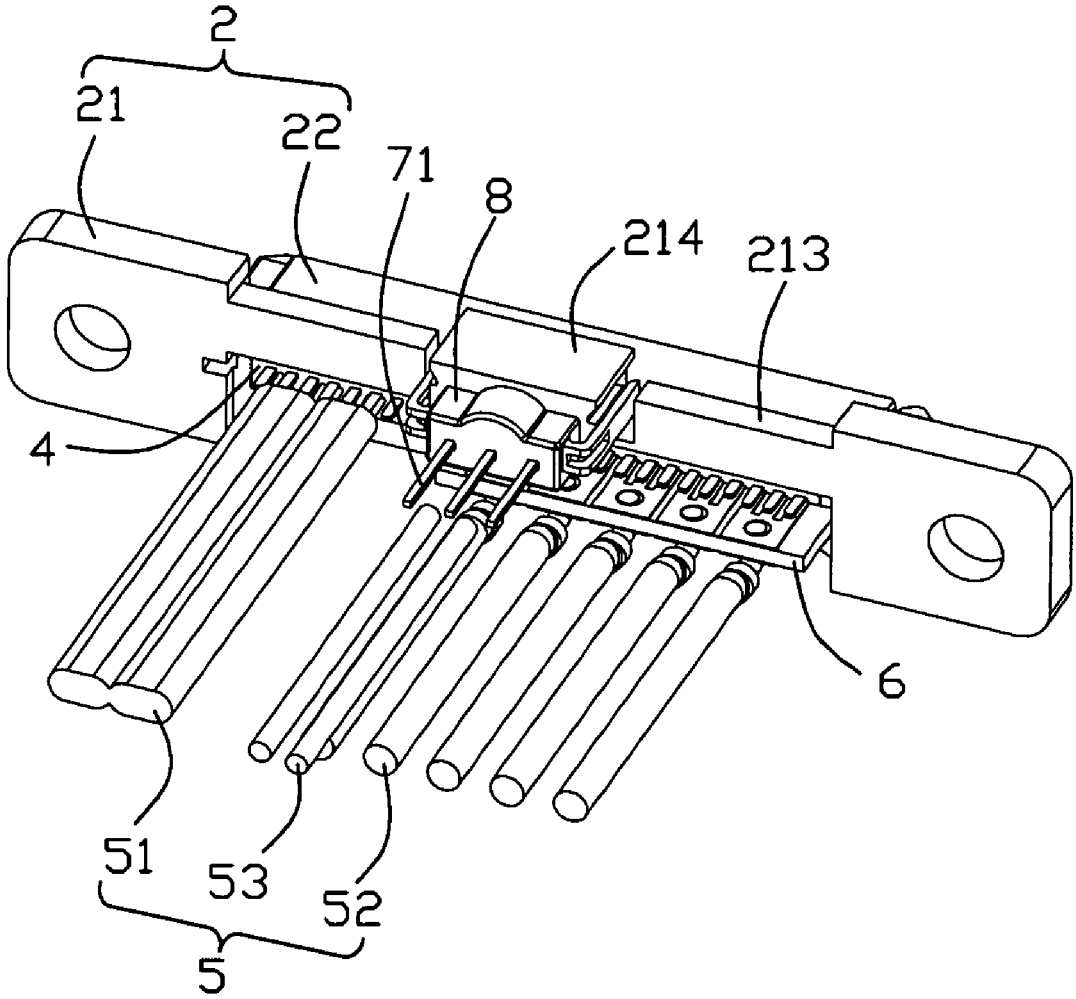
FIG. 4 is partially assembled, perspective view of the cable assembly.
Figure 5:
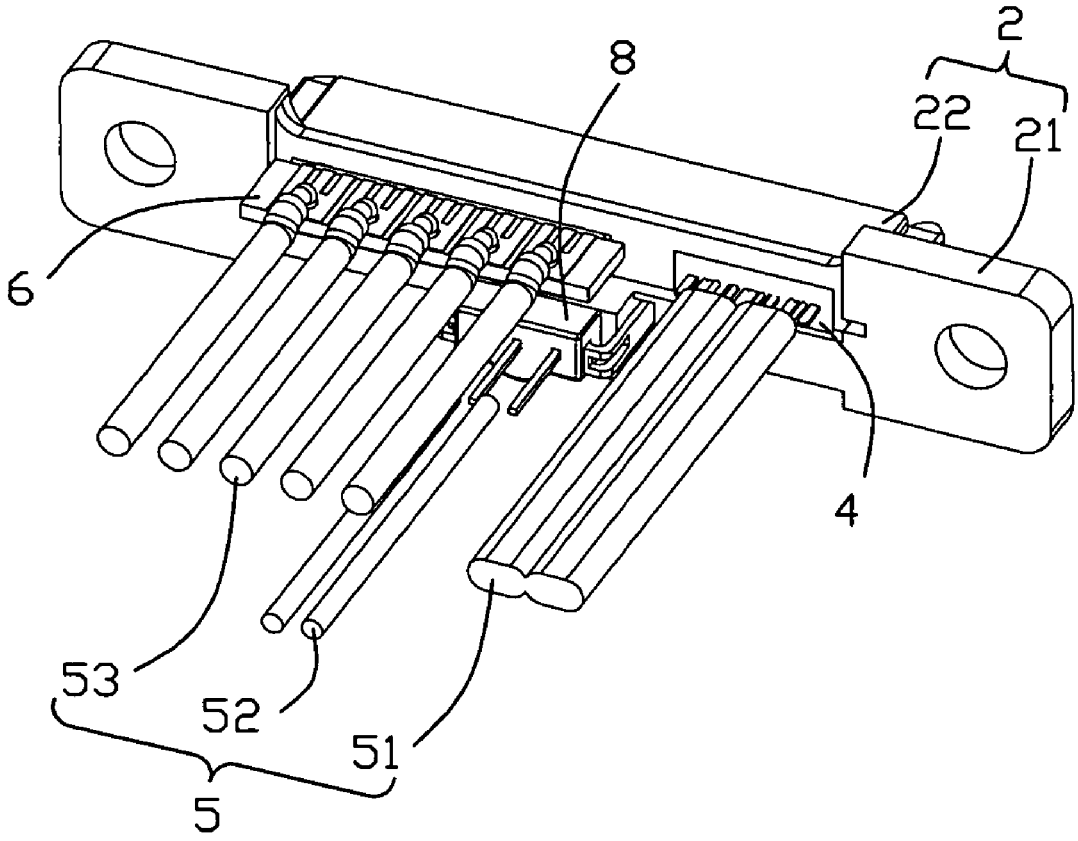
FIG. 5 is similar to FIG. 4, but viewed from another aspect.

Referring to FIGS. 1-5, a cable assembly 1 in accordance with the present invention comprises an insulated housing 2, a plurality of terminals 3 received in the insulated housing 2, a pair of spacers 4, a plurality of cables 5, a printed circuit board (PCB) 6, a sensor 7, a lid member 8 and an external cover 9.

The insulated housing 2 includes an elongated base portion 21 and a mating portion 22 extending forwardly from a front surface 211 of the base portion 21.

The mating portion 22 has a top wall 222, a bottom wall 223 and a pair of side walls (not numbered) interconnected together to enclose two juxtaposed L-shaped mating ports 221. A plurality of terminals slots 224 extend through an front and a back surface of the top wall 222. A retainer 214 is formed on a middle section of an upper surface of the base portion 21 and rearward extends beyond back surface of the base portion 21, and two flange portions 213 protrude upwardly from a middle lateral sections of the up surface of the base portion 21, with two gaps 212 located between the retainer 214 and the two flange portions 213. A substantially semi-circular shaped cavity 215 is defined in the retainer 214, and the cavity 215 further has a front opening and a rear outlet (not numbered). The front opening is adjacent to a top surfaces of the mating portion 22. A first notch 216 and second notch 217 are respectively defined in a top and a front sections of each of lateral sides of the retainer 214. Two recess portions 219 are recessed forwardly from the back surface of the base portion 21, and a plurality of terminal retention passages 218 are defined in the base portion 21 and disposed in front of the recess portion 219. The recess portions 219 are in communication to the terminals slots 224 via the terminal retention passages 218 therebetween. It should be noted that the retainer 214 may be part of the base portion 21.

The terminals 3 are stamped of sheet metal and separated into a set of first terminals 3*a* and a set of second terminals 3*b* distinct from one another along a transversal direction. Each of the terminals 3 has a contacting portion 31, a tail portion 32 and a retention portion 33 interconnecting the contacting portion 31 and a tail portion 32.

Each of the spacer 4 includes a rectangular-shaped main portion 41 and a number of ribs 42 extending forwardly from an upper section of a front surface thereof. A number of holes 411 slotted through middle sections of the front surface and the back surface of the main portion 41.

The cables 5 includes first cables 51, second cables 52 and third cables 53. The first cables 51 has a number of wires (not numbered) electrically connected to the first terminals 3*a*, the second cables 52 electrically connected to the second terminals 3*b* and the third cables 53 electrically connected to the sensor 7.

The PCB 6 has a rectangular-shaped substrate (not numbered), with a plurality of conductive pads 61 arranged on the front section thereof and a number of conductive holes 62 defined in the back section of the substrate. The tail portions 32 of the second terminals 3*b* are soldered on the conductive pads 61, while conductors (not numbered) of the second cables 52 are inserted into the conductive holes 62 and soldered therein, respectively.

The sensor 7 is accommodated in the cavity 215 of the retainer 214, with three legs 71 thereof disposed outside of the retainer 214. The sensor 7 may be a transistor, a diode etc.

The lid/cap member 8 includes a body portion 81 and two L-shaped locking arms 82 extending forwardly from lateral sides of the body portion 81. A slit 811 is recessed rearward from a front surface of the body portion 81 and three passages 812 are recess forwardly from a back surface of the body portion 81 and further in communication to the slit 811. Each of the locking arms 82 further has a hook portion 812 formed at a front end thereof.

The external cover 9 is made of plastic material or other insulative material, which is molded over the base portion 2 and partial of the cable 5 which is adjacent to the base portion 2.

When assemble, the terminals 3 are first inserted into the insulated housing 2, with contacting portions 31 extending into the terminals slots 224, the retention portions 33 disposed in the terminal retention passages 218, and the tail portions 32 disposed outside of the back surface of the base portion 21. Secondly, the two spaces 4 are mounted to the recess portions 219 of the base portion 21, with the tail portions 32 passing through the holes 411 thereof, and the ribs 42 jammed into the retention passages 218 to secure the retention portions 32 with the base portion 21 together. Thirdly, the first cables 51 are soldered on the tail portions 32 of the set of first terminals 3*a*, the tail portions 32 of the set of second terminals 3*b* are soldered on the conductive pads 61 of the PCB 6, and the conductors of the second cables 51 are soldered to the conductive holes 62 of the PCB 6, therefore, the first and second cables 51, 52 are electrically connected to the terminals 3.

Fourthly, the sensor 7 is assembled to the cavity 215 of the retainer 214 via the rear outlet thereof and the lid member 8 latches with the retainer 214 to cover/seal/shield the rear outlet (not numbered) of the cavity 215 to prevent the sensor 7 sliding outward. The pair of latching arms 82 of the lid member 8 hold the lateral sides of the retainer 214 and the hook portions 821 thereon lock into the first notches 216 of the retainer 214. The legs 71 of the sensor 7 extend into the slit 811 and then extend outward of the lid member 8 via passages 812. Fifthly, the third cables 53 are soldered to the legs 71 of the sensor 7. Sixthly, the melted insulative material is molded over the base portion 21, the lid member 8 and the cable 5 nearby the base portion 21 to form the external cover 9. As the sensor 7 is accommodated in the retainer 214 and the body portion 81 seals/covers/shields the rear outlet of the cavity 215, thus the sensor 7 is not easily be damaged during molding process.

When the cable assembly 1 mates with a complementary connector (not shown) mounted to a Hard Disk (HD) or other electronic device, the sensor 7 is capable of detecting temperature or other running signal parameters of the electronic device and transform it into an electrical signal, then the electrical signal is transmitted to a control system of a device (not shown) via the third cables 53.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

The invention claimed is:

1. A cable assembly, comprising:

an insulated housing having a base portion and a mating portion extending forwardly from the base portion;

a plurality of terminals received in the insulated housing;

a retainer formed on the base portion, said retainer defining a cavity with a rear outlet;

a sensor accommodated in the cavity of the retainer; and a lid member covering the rear outlet of the retainer;

wherein the sensor has at least two legs extending outside via through holes in the body portion of the lid member;

wherein an external cover is molded over the base portion, the lid member and the cables adjacent to the base portion.

2. The cable assembly as recited in claim 1, wherein the lid member includes a body portion shielding the rear outlet and a pair of lock arms latching with the retainer.

3. The cable assembly as recited in claim 2, wherein each of the lock arms is configured L-shaped and extends forwardly from a lateral side of the body portion of the lid member.

4. The cable assembly as recited in claim 3, wherein a hook portion is formed at a front end of the lock arm and locked into a notch portion of the retainer.

5. The cable assembly as recited in claim 3, wherein the lock arms hold the retainer.

6. A cable connector assembly comprising:

an insulative housing defining a base with a mating section extending forwardly thereform and defining two juxtaposed different sized mating ports therein;

a plurality of terminals disposed in the mating ports;

a cavity formed in a middle section of the base and essentially located and occupied by a sensor;

a lid covering the sensor with through holes allowing legs of the sensor to extend therethrough rearwardly;

a plurality of wires connected to the terminals and the legs, respectively; and an overmolded cover sealing jointed portions of the wires and the terminals and the legs including said lid.

7. The cable assembly as recited in claim 1, wherein the sensor is a transistor or a diode.

8. A cable assembly, comprising:

an insulated housing having a base portion and a mating portion extending forwardly from the base portion;

a plurality of terminals received in the insulated housing;

a sensor received in a cavity defined in the base portion, said cavity has a front opening and a rear outlet, the front opening adjacent to one of a top and a bottom surfaces of the mating portion;

a cap member sealing the rear outlet of the cavity;

a number of cables electrically connected to the terminals; and an external cover molded over a rear portion of the insulated housing, the cap member and the cables adjacent to the insulated housing.

9. The cable assembly as recited in claim 8, wherein legs of the sensor extend outside via holes of cap member and soldered to the third cables.

10. The cable assembly as recited in claim 8, wherein the cap member has a body portion shielding the rear outlet and at least a locking arm latching with the insulated housing.

11. The cable assembly as recited in claim 8, wherein the terminals includes contacting portions extending into terminal slots of the mating portion, retention portions received in terminal retention passages of the base portion and tail portions extending outward via at least a recess portion defined in a rear portion of the base portion.

12. The cable assembly as recited in claim 11, wherein at least a corresponding spacer is mounted to the recess portion, wherein the tail portions of the terminals extend outward via holes defined in the spacer.

13. The cable assembly as recited in claim 12, wherein a number of ribs extend forwardly from a front surface of the spacer and are jammed into terminal retention passages.

14. The cable assembly as recited in claim 8, wherein the terminals are separated into a set of first terminals and a set of second terminal, wherein the set of first terminals are directly connected to first cables, and the set of second terminals are connected to second cables via a printed circuit board.

15. The cable assembly as recited in claim 14, wherein the printed circuit board has a plurality of conductive pads arranged on a front section thereof and a number of conductive holes defined in a rear section thereof, wherein tail portions of the second terminals are soldered on the conductive pads and conductors of the second cables are inserted into the conductive holes and soldered therein.

* * * * *